United States Patent [19]

Matsuda et al.

[11] 4,155,762

[45] May 22, 1979

[54] LIQUID DEVELOPER FOR BINARY DIAZO COPYING MATERIALS

[75] Inventors: Tsutomu Matsuda; Yoshio Hagiwara; Yoichi Arai; Takeo Hirabayashi, all of Tokyo, Japan

[73] Assignee: Ricoh Co., Ltd., Tokyo, Japan

[21] Appl. No.: 900,411

[22] Filed: Apr. 27, 1978

Related U.S. Application Data

[62] Division of Ser. No. 697,249, Jun. 17, 1976, abandoned.

[30] Foreign Application Priority Data

Jun. 3, 1975 [JP] Japan ..... 50-81223
Sep. 27, 1975 [JP] Japan ..... 50-116651

[51] Int. Cl.[2] ..... G03C 1/58; G03C 1/52; G03C 1/64

[52] U.S. Cl. ..... 96/49; 96/75; 96/91 R

[58] Field of Search ..... 96/49, 75, 91 R

[56] References Cited

U.S. PATENT DOCUMENTS

| | | | |
|---|---|---|---|
| 3,190,752 | 6/1965 | Hayakawa et al. | 96/109 |
| 3,199,982 | 8/1965 | Kashiwabara | 96/49 |
| 3,578,452 | 5/1971 | Parker | 96/49 |
| 3,615,529 | 10/1971 | Tajima et al. | 96/95 |
| 3,622,326 | 11/1971 | Yoshida | 96/49 |
| 3,666,467 | 5/1972 | Reynolds et al. | 96/49 |
| 3,891,438 | 6/1975 | Katz et al. | 96/49 |
| 3,891,439 | 6/1975 | Katz et al. | 96/49 |

FOREIGN PATENT DOCUMENTS

| | | | |
|---|---|---|---|
| 961515 | 6/1964 | United Kingdom | 96/49 |

*Primary Examiner*—Mary F. Kelley
*Attorney, Agent, or Firm*—Blanchard, Flynn, Thiel, Boutell & Tanis

[57] ABSTRACT

A liquid developer for use in developing binary diazo copying materials which consists essentially of an alkali metal salt of an aminoacid and/or an alkaline earth metal salt of an aminoacid.

7 Claims, No Drawings

LIQUID DEVELOPER FOR BINARY DIAZO COPYING MATERIALS

This is a division of application Ser. No. 697,249, filed June 17, 1976, now abandoned.

BACKGROUND OF THE INVENTION

1. Field of the Invention

The present invention relates to an improvement of developers for diazo copying materials, and particularly it relates to a liquid developer for use in developing binary diazo copying materials which consists essentially of an alkali metal salt of an aminoacid or an alkaline earth metal salt of an aminoacid or both of these salts.

2. Description of the Prior Art

As the prevalent method of developing binary diazo copying materials, there are the so-called wet process, dry process, thermal process and semi-dry process. Among these processes, the wet process is a method wherein the developing is performed by impregnating or coating a diazo copying material with a developer consisting essentially of an inorganic or organic alkaline compound. The dry process is a method wherein a diazo copying material is treated with, for instance, ammonia gas thereby effecting color development. And, the thermal process is a method wherein a photosensitive material prepared by coating a mixture consisting of a diazo compound, a coupler and an alkali-generating agent on a support is subjected to heating thereby generating alkali and effecting color development.

However, all of these conventional developing methods have various drawbacks such as follows.

(1) In the case of the wet process, water contained in the developer evaporates gradually to cause crystallization of the alkali ingredient of the developer or coloring of the developer in a long period of time thereby rendering it impossible to obtain a clear-cut copy stably at all times. Besides, depending on the kind of alkaline compound constituting the developer for use therein, there are instances where a loathsome offensive smell is given out.

(2) In the case of the dry process, because of the employment of ammonia for the developer, the very strong smell of ammonia poses a problem from the view point of environment sanitation. Besides, it requires a large-scale and expensive developing apparatus.

(3) In the case of the thermal process, because of the presence of a substance capable of thermally generating alkali within the photosensitive layer, the preservability of the photosensitive material inevitably is deteriorated.

As a measure for making up for the foregoing drawbacks of the prior art, a developer comprising an organic amine has been proposed (cf. Japanese Patent Publication No. 23515/1970). This developer makes it possible to perform the developing by just making a modicum of said developer adhere to the photosensitive layer surface of a binary diazo copying material, and therefore the developing method employing this developer deserves the name of 'semi-dry process'. However, even this semi-dry process is defective because the degree of coloring of said organic amine is so great that a conspicuous discoloring and fading of the resulting copy after development is inevitable. Moreover, the developer, when used for a long time, assumes a brown color, causing discoloring of the background of.

In this connection, as a means of overcoming the foregoing demerits of a developer employing organic amine, there have admittedly been proposed a variety of developers comprising some water-soluble alkali metal salt of carboxylic acid, water-soluble alkaline earth metal salt of carboxylic acid or water-soluble pyrolizable ammonium salt together with said organic amine (cf. Japanese Laid-open Application No. 24735/1973; Japanese Laid-open Application No. 60621/1973; Japanese Laid-open Application No. 60633/1973). However, as a matter of fact, all of these developers are defective in that they require a process of heating and drying, they give out an unpleasant smell at the time of thus drying, and they fail to produce a satisfactory copied image when used for a long time because of separation of the foregoing substances on account of the employment of water as diluent, and therefore they are still insufficient for practical use.

SUMMARY OF THE INVENTION

The present inventors, with a view to eliminating the afore described drawbacks of developers in the prior art, have made extensive inquiries into the developer and conducted a series of tests and examinations relevant thereto. And, as a result, they have come to find a fact that the employment of alkali metal salt of an aminoacid and alkaline earth metal salt of an aminoacid brings on a very satisfactory effect. The present invention has been accomplished on the basis of this finding.

One object of the present invention is to provide a developer for use in developing binary diazo copying materials which is free from the defects of the conventional developers for use in the aforesaid wet process through semi-dry process, which does not cause crystallization of ingredients thereof even when water and other solvent evaporate, and which provides a stable copy at all times. Another object of the present invention is to provide a developer for the purpose of developing binary diazo copying materials which provides a clear-cut copy with unstained background which will scarcely show discoloration or fading. To be precise, the present invention provides a liquid developer for use in developing binary diazo copying materials which consists essentially of an alkali metal salt of an aminoacid and/or an alkaline earth metal salt of an aminoacid.

Both of said alkali metal salt of an aminoacid and alkaline earth metal salt of an aminoacid to be employed as alkali agent for a liquid developer for binary diazo copying materials (hereinafter occasionally referred to as 'the developer' for short) are odorless and very hygroscopic substances having a high solubility toward alcohol-type organic solvents and water. Accordingly, in the case of an aqueous solution of these alkali agents, there takes place no crystallization of the alkali agent even when the organic solvent and water evaporate. Moreover, the employment of these alkali agents has various merits, such that, because they are hardly affected by contact with air compared with organic amines, discoloring and fading of the resulting copy can be minimized, and besides, the background of the copy is unstained as the rate of coloring of the liquid developer by oxidation is negligible.

As the alkali metal salt or alkaline earth metal salt of an aminoacid employed as alkali agent for the purpose as set forth above, sodium salt, potassium salt, lithium salt, magnesium salt, calcium salt, barium salt, etc. of L-α-alanine, DL-α-alanine, β-alanine, L-alloisoleucine, L-α-aminobutyric acid, D-β-aminobutyric acid, DL-β-aminobutyric acid, γ-aminobutyric acid, DL-α-aminobutyric acid, L-asparagine, D-asparagine, L-asparatic acid, DL-asparatic acid, L-asterubine, L-canavanine, L-citrulline, creatine, creatinine, L-cysteine, L-cystine, D-cystine, L-glutamic acid, D-glutamic acid, DL-glutamic acid, L-glutamine, glycine, L-histidine, L-α-hydroxyproline, L-β-hydroxyproline, L-isoleucine, DL-isoleucine, L-leucine, DL-leucine, L-lysine, L-methionine, DL-methionine, L-norleucine, D-norleucine, L-norvaline, D-norvaline, DL-norvaline, L-octopine, DL-ornithine, L-ornithine, L-phenyl alanine, β-phenyl alanine, DL-phenyl alanine, D-phenyl alanine, L-proline, sarcosine, L-serine, DL-serine, taurine, L-threonine, L-tryptophan, L-tyrosine, DL-tyrosine, L-α-valine, DL-α-valine and β-valine are employed independently or upon mixing two or more of them.

As the solvent for these alkaline agents (to wit, alkali metal salt or alkaline earth metal salt of aminoacid), the following substances can be cited. That is, in addition to water, glycol or glycol ether are suitable. To enumerate applicable glycols and glycol ethers, there are ethylene glycol, diethylene glycol, triethylene glycol, tetraethylene glycol, polyethylene glycol, propylene glycol, dipropylene glycol, tripropylene glycol, polypropylene glycol, glycerin, trimethylene glycol, tetramethylene glycol, butane diol, 1,5-pentane diol, hexylene glycol, actylene glycol, ethylene glycol monomethyl ether, ethylene glycol monoethyl ether, ethylene glycol diethyl ether, ethylene glycol isopropyl ether, ethylene glycol monobutyl ether, ethylene glycol dibutyl ether, diethylene glycol monomethyl ether, diethylene glycol monoethyl ether, diethylene glycol dimethyl ether, diethylene glycol diethyl ether, triethylene glycol monomethyl ether, triethylene glycol monomethyl ether, tetraethylene glycol monoethyl ether, propylene glycol monoethyl ether, propylene glycol monobutyl ether, 1-butoxyethoxypropanol, etc., and these substances are employed independently or upon mixing two or more of them.

The foregoing alkali agent is preferably applied at a concentration in the range of from 2 to 40 wt.%. In this context, in the case where the solvent employed consists of water alone, the developer according to the present invention is used in the wet process. When the developer of the present invention is intended for use in the semi-dry process, the solvent employed therein is to be the above described organic solvent, and especially the presence of water in said developer to the extent of 5 to 20 wt.% or thereabouts is desirable. It has been confirmed that by virtue of the addition of water to said organic solvent, the solubility of alkali agent is enhanced and the rate of color developing of the resulting copy is improved; yet, in the case where the ratio of water added is less than 5 wt.%, the foregoing effect is scanty, while in the case where said ratio exceeds 20 wt.%, the dryness of the copy after developing becomes insufficient, and therefore a developer thus prepared becomes unsuitable for the semi-dry process.

Further, in the case where the developer of the present invention is intended for use in the wet process, the solvent to be employed can be a mixture of water and organic solvent, not water alone; however, for the reason as set forth above, when the ratio of water in the developer has become less than 20 wt.%, said developer is supposed to be appropriated for use in the semi-dry process.

As will be clear from the above description, the developer of the present invention suffices to contain 2 to 40 wt.% of an alkali agent dissolved in an organic solvent or water or a mixture of organic solvent and water. And, in the case where the amount of organic solvent contained in the solvent as a whole is relatively large, the resulting developer according to the present invention can be appropriated for use in the semi-dry process, while in the case where the amount of water contained in the solvent as a whole is relatively large, the resulting developer according to the present invention can be appropriated for use in the wet process.

As explained in the foregoing, the developer of the present invention consists essentially of an alkali metal salt or alkaline earth metal salt of aminoacid or a mixture of these salts, and it is applicable to binary diazo copying materials in general use. To give instances of the conventional diazo copying materials which will render a copied image with satisfactory coloring and high concentration especially by virtue of the use of the present developer, there are binary diazo copying materials prepared by employing a zinc chloride double salt such as 4-diazo-2,5-diethoxymorpholinobenzene chloride, 4-diazo-2,5-dibutoxymorpholinobenzene chloride, 4-diazo-N,N-dipropylaniline chloride, 4-diazo-2,5-diethoxy-4-(4'-methoxy)benzoyl aminobenzene chloride, etc. as diazo compound and also employing 2,3-dihydroxynaphthalene, 2,3-dihydroxynaphthalene-6-sodium sulfonate, 2-hydroxy-3-naphthoic acid-β-aminoethyl amide, 2-hydroxy-3-naphthoic acid ethanol amide, 2-hydroxy-3-naphthoic acid morpholinoethyl amide, 2-hydroxy-3-naphthoic acid morpholino-propyl amide, 1-biguanidino-7-naphthol, resorcine, α-resorcinic acid ethanol amide, ethylene diamine-N,N'-bisacetoacetoamide, diresorcine, etc. as coupling ingredient.

In order to develop a diazo copying material with the present developer, it suffices to make just a modicum of the developer adhere to the surface of the photosensitive layer of the copying material subjected to exposure to the extent of slightly moistening said surface. Though the amount of the developer to be made to adhere to the photosensitive layer surface to 'the extent of slightly moistening' said surface depends on the concentration of alkali agent (coupled with the mixing ratio of organic solvent or water), it is generally in the range of from 1 to 3 g/m$^2$. As to the means of making the present developer adhere to the photosensitive layer surface, it will do to adopt, for instance, the roll transfer process prevailing in the conventional offset printing, etc. In this connection, in the case of the wet process wherein the amount of the adhering developer is supposed to be more than 3 g/m$^2$, preferably in the range of from 3 to 6 g/m$^2$, a sponge roller, a grooved roller and the like can be used so as to coat or impregnate the copying material with relatively much developer.

As described hereinabove, in the case of applying the present developer, the amount of the developer to be made to adhere to the photosensitive layer surface is very small. Therefore, it can be said that the way to use the present developer is akin to the dry process rather than the semi-dry process or the wet process. Besides, in the case of the present developer, occurrence of crystallization in the liquid can be avoided, and the resulting copy is always clear and in the state of being dry or akin thereto.

DESCRIPTION OF THE PREFERRED EMBODIMENT

EXAMPLE 1

A liquid consisting of the following ingredients was first prepared.

| | |
|---|---|
| water | 800 ml |
| ethylene glycol | 30 ml |
| isopropyl alcohol | 30 ml |
| citric acid | 20 g |
| thiourea | 30 g |
| 2-hydroxy-3-naphthoic acid ethanol amide | 15 g |
| caffeine | 10 g |
| 4-diazo-2,5-dibutoxymorpholino-benzene chloride (zinc chloride double salt) | 10 g |
| saponin | 1 g |

Subsequently, by further adding water to this liquid so as to make the whole quantity of the liquid 1 l, a photosensitive liquid was prepared. Then, by coating the thus prepared photosensitive liquid on a stencil paper weighing 90 g/m$^2$ for use in preparing photosensitive materials and drying thereafter, a binary diazo copying material was prepared.

Next, after exposing this copying material together was an appropriate original superposed thereon by the use of a fluorescent lamp, by coating a variety of liquid developers having the composition No. 1 through No. 11 (wherein No. 10 and No. 11 are compositions for the purpose of comparison) as listed in the following, respectively, on the surface of the thus exposed copying material with a rubber roller, developing was performed. In this connection, the amount of liquid developer thus coated was adjusted to be in the range of from 1.5 to 2.0 g/m$^2$. The result was as shown in Table-1 below, and the respective developers manifested a satisfactory effect with the exception that some remnant of moisture was sensed on the copying material in the case of the composition No. 3. Further, when the rubber roller was left intact after use in applying each liquid developer, occurrence of crystallization was observed in the case of liquid developers of the composition No. 10 and No. 11, while in the case of liquid developers of the composition No. 1 through No. 9, there was observed no occurrence of crystallization.

| Composition No. | Ingredients of liquid developer | Mixing ratio (wt. %) |
|---|---|---|
| 1 | DL-α-sodium aminobutyrate | 15 |
| | ethylene glycol | 70 |
| | water | 15 |
| | Ca salt of L-α-alanine | 25 |
| 2 | propylene glycol | 65 |
| | water | 10 |
| | Li salt of glycine | 24 |
| 3 | diethylene glycol monomethyl ether | 46 |
| | water | 30 |
| | K salt of L-arginine | 18 |
| 4 | diethylene glycol | 64 |
| | water | 18 |
| | Mg salt of L-leucine | 23 |
| 5 | hexylene glycol | 67 |
| | water | 10 |
| | Na salt of DL-proline | 16 |
| 6 | diallopyrene | 76 |
| | water | 8 |
| | γ-potassium aminobutyrate | 15 |
| 7 | diethylene glycol monoethyl ether | 72 |
| | water | 13 |
| | L-calcium glutamate | 20 |
| 8 | triethylene glycol | 68 |
| | water | 12 |
| | K salt of DL-α-valine | 16 |
| 9 | polyethylene glycol | 75 |
| | water | 9 |
| 10 (Comparative Composition) | monoethanol amine | 20 |
| | triethanol amine | 30 |
| | diethylene glycol monomethyl ether | 50 |
| 11 (Comparative Composition | monoethanol amine | 30 |
| | ethylene glycol | 60 |
| | hexylene glycol | 10 |

Table -1

| Sample No. | Color-developing rate *1 30 sec. | 1 min. | 10 min. | 30 min. | Fading rate *2 R max. | R min. | Coloring of *3 ground | Odor of *4 copy |
|---|---|---|---|---|---|---|---|---|
| 1 | 0.74 | 0.88 | 1.00 | 1.10 | 9.5 | 11.3 | 0.09 | odorless |
| 2 | 0.82 | 0.91 | 1.01 | 1.08 | 7.8 | 9.9 | 0.08 | odorless |
| 3 | 0.81 | 0.90 | 1.03 | 1.09 | 9.4 | 10.8 | 0.10 | odorless |
| 4 | 0.80 | 0.92 | 1.04 | 1.10 | 8.3 | 10.8 | 0.07 | odorless |
| 5 | 0.83 | 0.94 | 1.08 | 1.15 | 7.2 | 10.3 | 0.09 | odorless |
| 6 | 0.78 | 0.92 | 1.04 | 10.8 | 8.1 | 10.5 | 0.09 | odorless |
| 7 | 0.79 | 0.93 | 1.04 | 1.07 | 9.3 | 11.2 | 0.08 | odorless |
| 8 | 0.83 | 0.96 | 1.06 | 1.08 | 7.9 | 10.9 | 0.08 | odorless |
| 9 | 0.80 | 0.94 | 1.03 | 1.06 | 8.2 | 11.1 | 0.11 | odorless |
| 10 | 0.80 | 0.95 | 1.05 | 1.06 | 20.3 | 15.4 | 0.18 | smell of amine |
| 11 | 0.82 | 0.96 | 1.04 | 1.07 | 21.4 | 16.2 | 0.20 | smell of amine |

(Remarks)

*1:The image concentration value after developing was measured with a photovoltaic densitometer.

*2:After conducting 3 hours' forced fading test by means of a brown-color fastness tester (the manufacture of TOYO RIKAKOGYO K.K.), and measuring the concentration of image area (D max.) as well as the concentration of non-image area (D min.) of a sample not undergone said forced fading test and the concentration of image area (D' max.) as well as the concentration of non-image area (D' min.) of a sample undergone said forced fading test by means of a photovoltaic densitometer, the fading rates R max. and R min. were calculated by applying the following equations.

$$R\ max. = \frac{D\ max. - D'\ max.}{D\ max.} \times 100$$

$$R\ min. = \frac{D'\ min. - D\ min.}{D\ min.} \times 100$$

*3:In order to examine the degree of coloring of the ground by a deteriorated liquid, the sample was developed with a liquid developer which had been left intact for a month within a developing machine, and then the concentration of non-image area was measured with a photovoltaic densitometer.

*4:The odor of the copy immediately after the developing was judged olfactorily.

EXAMPLE 2

After exposing the same copying material as that in Example 1 together with an appropriate original superposed thereon by the use of a fluorescent lamp, by coating a variety of liquid developers having the composition No. 12 through No. 20 (wherein No. 19 and No. 20 are compositions for the purpose of comparison), respectively, as listed in the following Table-2, on the surface of the thus exposed copying materials with a sponge roller, developing was performed. The result was as shown in Table-2.

Table-2

| Sample No. | Composition of liquid developer wt. 90) | | Amount of developer made to adhere ($g/m^2$) | Concentration of image *5 | Condition of sponge roller after leaving intact *6 | Condition of image when copying was performed under the condition shown in the left column *7 |
|---|---|---|---|---|---|---|
| 12 | K salt of glycine | (5) | 4.5 | 1.06 | no crystallization occurred | uniform and satisfactory |
| | Water | (95) | | | | |
| 13 | Na salt of β-alanine | (12) | | | | |
| | Water | (88) | 3.1 | 1.09 | the same as above | the same as above |
| | K salt of α-aminobutyric acid | (9) | | | | |
| 14 | Water | (91) | 3.9 | 1.05 | the same as above | the same as above |
| | Na salt of L-leucine | (25) | | | | |
| 15 | Water | (75) | 2.0 | 1.08 | the same as above | the same as above |
| | Na salt of L-α-valine | (6) | | | | |
| 16 | Water | (94) | 4.8 | 1.05 | the same as above | the same as above |
| | Li salt of L-cystein | (13) | | | | |
| 17 | Water | (87) | 3.2 | 1.02 | the same as above the same as above | |
| | Mg salt of L-histidine | (31) | | | | |
| 18 | Water | (69) | 1.8 | 1.10 | the same as above | the same as above |
| 19 (Comparative sample) | Potassium methaborate | (10) | | | Crystalization occurred | Granular developing marks were observed. |
| | Water | (90) | 4.3 | 0.95 | | |
| 20 (Comparative sample | Potassium carbonate | (6) | | | Crystallization occurred | Long and narrow developing marks were observed |
| | Potassium tetraborate | (5) | 3.8 | 0.92 | | |
| | Water | (89) | | | | |

(Remarks)
*5:The concentration of image 30 seconds after the copying was measured with a photovoltaic densitometer.
*6:The condition was examined with the naked eye after leaving the sponge roller intact for 2 week within a copying machine.
*7:The copying was conducted by using the sponge roller left intact for 2 weeks within a copying machine, and the condition of image of the resulting copy was examined with the naked eye.

What is claimed is:

1. A process for preparing diazotype copies which comprises applying to an imagewise exposed binary diazotype paper, a thin layer of a liquid developer consisting essentially of an alkali metal salt or an alkaline earth metal salt of an amino acid or mixtures thereof, and the balance is essentially a solvent selected from the group consisting of water, glycols, glycol ethers and mixtures thereof.

2. A process according to claim 1 in which said liquid developer contains from 2 to 40 weight percent of said amino acid salt.

3. A process according to claim 1 in which said solvent is water.

4. A process according to claim 1 in which said solvent is a glycol, a glycol ether or mixtures thereof.

5. A process according to claim 1 in which said solvent consists of 5 to 20 weight percent of water based on the weight of the liquid developer, and the balance is a glycol, a glycol ether or mixtures thereof.

6. A process according to claim 1 in which said solvent consists of a mixture of water and a glycol, a glycol ether or mixtures thereof wherein the amount of water exceeds 20 weight percent, based on the weight of the liquid developer.

7. A process according to claim 1 in which said salt is selected from the group consisting of the sodium, potassium, lithium, magnesium, calcium and barium salts of L-α-alanine, DL-α-alanine, β-alanine, L-alloisoleucine, L-α-aminobutyric acid, D-β-aminobutyric acid, DL-β-aminobutyric acid, γ-aminobutyric acid, DL-α-aminobutyric acid, L-asparagine, D-asparagine, L-aspartic acid, DL-asparatic acid, L-asterubine, L-canavanine, L-citrulline, creatine, creatinine, L-cysteine, L-cystine, D-cystine, L-glutamic acid, D-glutamic acid, DL-glutamic acid, L-glutamine, glycine, L-histidine, L-α-hydroxypropline, L-β-hydroxypropline, L-isoleucine, DL-isoleucine, L-leucine, DL-leucine, L-lysine, L-methionine, DL-methionine, L-norleucine, D-norleucine, L-norvaline, D-norvaline, DL-norvaline, L-octopine, DL-ornithine, L-ornithine, L-phenyl alanine, β-phenyl alanine, DL-phenyl alanine, D-phenyl alanine, L-proline, sarcosine, L-serine, DL-serine, taurine, L-threonine, L-tryptophan, L-tyrosine, DL-tyrosine, L-α-valine, DL-α-valine, β-valine and mixtures thereof, and said glycols and glycol ethers are selected from the group consisting of ethylene glycol, diethylene glycol, triethylene glycol, tetraethylene glycol, polyethylene glycol, propylene glycol, dipropylene glycol, tripropylene glycol, polypropylene glycol, glycerin, trimethylene glycol, tetramethylene glycol, butane diol, 1,5-pentane diol, hexylene glycol, acetylene glycol, ethylene glycol monomethyl ether, ethylene glycol monoethyl ether, ethylene glycol diethyl ether, ethylene glycol isopropyl ether, ethylene glycol monobutyl ether, ethylene glycol dibutyl ether, diethylene glycol monomethyl ether, diethylene glycol monoethyl ether, diethylene glycol dimethyl ether, diethylene glycol diethyl ether, triethylene glycol monomethyl ether, triethylene glycol monomethyl ether, tetraethylene glycol monoethyl ether, propylene glycol monoethyl ether, propylene glycol monobutyl ether, 1-butoxyethoxypropanol and mixtures thereof.

* * * * *

UNITED STATES PATENT AND TRADEMARK OFFICE

CERTIFICATE OF CORRECTION

PATENT NO. : 4 155 762

DATED : May 22, 1979

INVENTOR(S) : Tsutomu Matsuda et al

It is certified that error appears in the above-identified patent and that said Letters Patent are hereby corrected as shown below:

Column 8, line 4; change "DL-asparatic" to

---DL-aspartic---.

Signed and Sealed this

*Seventh* Day of *August 1979*

[SEAL]

*Attest:*

*Attesting Officer*

LUTRELLE F. PARKER

*Acting Commissioner of Patents and Trademarks*